United States Patent [19]

Albrecht et al.

[11] Patent Number: 4,962,622

[45] Date of Patent: Oct. 16, 1990

[54] PROFILED SHEET METAL BUILDING UNIT AND METHOD FOR MAKING THE SAME

[75] Inventors: Raymond E. Albrecht, Sewickley; Charles R. Gray, Aliquippa, both of Pa.

[73] Assignee: H. H. Robertson Company, Pittsburgh, Pa.

[21] Appl. No.: 359,585

[22] Filed: Jun. 1, 1989

[51] Int. Cl.[5] ..... E04C 2/32

[52] U.S. Cl. ..... 52/630; 52/221; 52/795; 72/180

[58] Field of Search ..... 52/220, 221, 630, 450, 52/336, 334; 72/168, 178, 179, 180

[56] References Cited

U.S. PATENT DOCUMENTS

| | | | |
|---|---|---|---|
| 3,150,707 | 9/1964 | Howell | 72/177 |
| 3,165,815 | 1/1965 | Wogerbauer | 72/177 |
| 3,184,942 | 5/1965 | Cookson | 72/179 |
| 3,256,566 | 6/1966 | Campbell | 18/19 |
| 3,397,497 | 8/1968 | Shea et al. | 52/334 |
| 3,690,137 | 9/1972 | Cookson | 72/180 |
| 3,812,636 | 5/1974 | Albrecht et al. | 52/334 |
| 3,841,134 | 10/1974 | Falkner | 72/181 |
| 4,144,369 | 3/1979 | Wass | 428/183 |
| 4,233,833 | 11/1980 | Balinski | 72/180 |
| 4,317,350 | 3/1982 | Sivachenko | 72/177 |
| 4,433,565 | 2/1984 | Preller | 72/202 |
| 4,453,364 | 6/1984 | Ting | 52/630 |
| 4,619,131 | 10/1986 | Zeman | 72/168 |
| 4,685,319 | 8/1987 | Aoyagi | 72/177 |
| 4,726,159 | 2/1988 | Stohs | 52/99 |
| 4,770,018 | 9/1988 | Bosl | 72/177 |
| 4,876,837 | 10/1984 | Kelly | 52/254 |

FOREIGN PATENT DOCUMENTS

| | | | |
|---|---|---|---|
| 2118517 | 12/1971 | Fed. Rep. of Germany | 72/180 |
| 8402051 | 1/1986 | Netherlands | 72/177 |

*Primary Examiner*—John E. Murtagh

*Attorney, Agent, or Firm*—G. E. Manias

[57] ABSTRACT

An improved cold formed, sheet metal profiled building unit and method of making the same are disclosed. The building unit incorporates at least one longitudinal stiffening rib in a longitudinal flat region of the type having a tendency to buckle when subjected to compressive forces. The longitudinal stiffening rib is formed not by drawing-in sheet metal as in current roll forming practices, but, instead, by stretching a segment of the sheet metal. Each longitudinal rib has a profile width, as measured along the centerline of the rib, which is greater than the linear of the sheet metal segment from which it was stretched-in. Roll forming machines incorporating the principles of this invention utilize fewer roll stands than do roll forming machines incorporating the principles of current roll forming practices.

6 Claims, 7 Drawing Sheets

PROFILED SHEET METAL BUILDING UNIT AND METHOD FOR MAKING THE SAME

BACKGROUND OF THE INVENTION

1. Field of the Invention:

This invention relates to cold formed, sheet metal, profiled building units such as those useful as floor, wall or roof elements or other structural elements, and more particularly to improvements in such profiled building units and method for making the same.

2. Description of the Prior Art:

Roll formed sheet metal decking units currently present integral embossments, indents and formed ribs that interlock with a layer of concrete poured thereover to provide a composite floor slab. Such sheet metal decking units have been produced for more than twenty-five years and have been used in hundreds of millions of square feet of composite floor slabs.

Such decking units typically present flat regions, such as, alternating crests and valleys and sloped webs connecting adjacent ones of the crests and valleys. Since the sheet metal used to produce the decking unit has a substantially uniform thickness and since the decking units are roll formed, the crests, the valleys, the webs and the longitundinal stiffening ribs also are essentially of substantially the same uniform thickness with some minor localized stretching occurring at the outer periphery of the radii portions and minor localized compressing occuring at the inner periphery of the radii portions. In current roll forming practice, the smaller individual intermittent indents and embossments of composite decking units are stretched-in.

One of the earliest roll formed decking units exhibiting composite characteristics, utilized only embossments or their equivilents in the webs, see SHEA U.S. Pat. No. 3,397,497.

A later roll formed composite decking unit utilized longitundinal ribs in the crests and in the webs as well as embossments in the webs and in the valleys to provide a decking unit having improved "wet strength" and "composite characteristics" superior to those of the SHEA '497 decking unit, see for example ALBRECHT et al. U.S. Pat. No. 3,812,636. Other recent examples of such roll formed composite sheet metal decking units will be found in WASS U.S. Pat No. 4,144,369; TING U.S. Pat. No. 4,453,364; and STOHS U.S. Pat. No. 4,726,159.

Other building units having flat regions requiring stiffening against buckling, include corrugated roof deck, and wall structure elements such as profiled facing sheets and liner sheets. The prior art is replete with examples of such building units.

Currently the building units, such as, facing sheets, liner sheets, and decking units; and individual structural elements, such as, hat-shaped subgirts of various depths are roll formed by passing a sheet metal strip of uniform thickness through successive stands containing forming rolls wherein the sheet metal strip is reshaped incrementally into the desired profile. As the strip travels through the roll forming apparatus, the opposite sides of the sheet metal strip are freely drawn-in laterally to provide sheet metal for forming the overall profile and the longitudinal ribs. The free lateral draw-in of the sheet metal is desired to avoid stretching or tearing of the sheet metal, see for example COOKSON U.S. Pat. No. 3,184,942; CAMPBELL U.S. Pat. No. 3,256,566; and COOKSON U.S. Pat. No. 3,690,137.

Thus designers of building units must utilize sheet metal strips of a width sufficient to provide not only for the profile itself but also for the stiffener ribs formed in the various flat regions of the building units. Similarly, designers of individual structural elements must utilize sheet metal strips of a width sufficient for the desired profile. Since the cost of the sheet metal used to produce these components comprises a very high percentage of the total product cost, efficient utilization of the sheet metal in the design of these components is most important. Heretofore with regard to building units, a savings in the sheet metal usage could be achieved by eliminating one or more of the stiffening ribs, by reducing the depth of the decking unit, or by using a lighter gauge sheet metal. With regard to the individual structural elements, a savings in the sheet metal usage could be achieved by reducing the depth of the element or by using a lighter guage sheet. The resultant savings were balanced against the loss in strength and span capability of the building unit. More often than not, no changes were made or at most very minor changes were made.

BRIEF SUMMARY OF THE INVENTION

The principal objects of this invention are to provide improved cold formed, sheet metal, profiled building units and a method of making the same.

Another object of this invention is to provide a profiled building unit having longitudinal stiffener ribs that are stretched-in thereby resulting in a savings in the weight of metal required per unit of cover width.

Still another object of this invention is to provide a method of making the present profiled building unit, which method when accomplished by roll forming apparatus, achieves a reduction in the number of stands required to roll form the present profiled building unit.

A still further object of this invention is to provide a sheet metal structural element having a U-shaped central portion or stiffening rib that is formed by stretching a segment of the sheet metal strip from which it is formed.

In its broadest aspects, the present invention provides improvements in cold formed, profiled building units of the type used as floor, roof or wall elements. The profiled building unit is formed from a sheet metal strip of substantially uniform sheet thickness and having at least one flat region that is subject to buckling under compressive forces. Examples of such flat regions include the crests and the valleys of profiled floor deck and roof deck, and of profiled facing sheets used as the exposed face of wall and roof structures; and the flat central web of liner sheets used as the interior face of wall structures.

In accordance with the present invention, at least one stiffening rib is formed in the flat region. The rib extends along substantially the entire length of the flat region and has a substantially uniform rib thickness that is less than the uniform sheet thickness of the sheet metal strip. The flat region on opposite sides of the stiffening rib has a thickness substantially equal to the uniform sheet thickness of the sheet metal strip. In accordance with known principles of sheet metal design, the number of stiffening ribs formed depends on the width/thickness ratio of the flat region.

In another of its aspects, the present invention provides improvements in cold formed structural elements, such as, a hat-shaped subgirt. The structural element has a U-shaped central portion or stiffening rib that provides the stiffness and stregth of the structural element.

In accordance with this invention, the stiffening ribs are formed not by being drawn-in as in current roll forming practices but, instead, by stretching a segment of the sheet metal strip. As a result of being stretched-in, the stiffening ribs each have a substantially uniform rib thickness that is less than the uniform thickness of the sheet metal; and a profile width, as measured along the centerline of the rib, that is greater than the linear width of the segment from which it was stretched-in. The overall arrangement is such that narrower sheet metal strips are used to form the present building units and the structural elements, since it is not necessary, as in current roll forming practice, to allocate sheet metal girth for the formation of the stiffening ribs.

These and other objects and advantages of the invention will become apparent from the following description with reference to the accompanying drawings.

DESCRIPTION OF THE PREFERRED EMBODIMENT(s)

Figure 1:
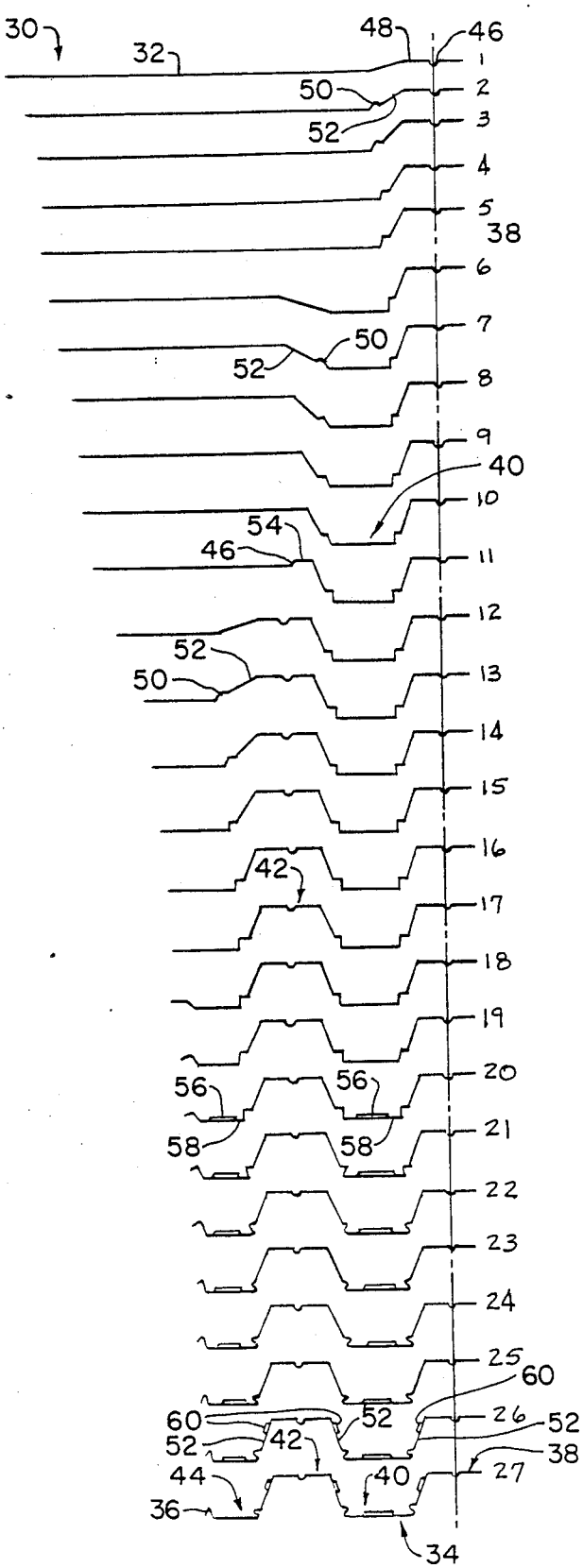
Fig. 1 PRIOR ART
FIG. 1 is a flow diagram schematically illustrating roll forming of a profiled sheet metal decking unit according to the prior art.

Referring to FIG. 1 there is shown a flow diagram 30 schmetically illustrating the profiling of a sheet metal strip 32 to produce a decking unit 34 according to roll forming practices of the prior art. FIG. 1 illustrates only one-half of the decking unit 34. The opposite half is essentially a mirror image of that half shown in FIG. 1 and differs only in having a male marginal connector (not visible) that cooperates with the female marginal connector 36 (FIG. 1) of an adjacent decking unit to connect the two units together. The decking unit 34 is of the type described and claimed in the aforesaid ALBRECHT et al., U.S. Pat No. 3,812,636, and, as illustrated, requires a twenty-seven roll forming stands.

As can be seen, the decking unit 34 includes a central flute 38, a lateral trough 40 adjacent thereto, a lateral flute 42 adjacent to the trough 40, and a partial valley 44 which includes the female marginal connector 36. As can be seen in FIG. 1, the central flute 38 is essentially completely formed at about roll forming stand No. 5. Formation of the lateral trough 40 is accomplished from roll forming stand No. 6 through roll forming stand No. 10. The formation of the lateral flute 42 begins at roll forming stand No. 6 and is essentially complete after roll forming stand No. 17. Formation of the partial valley 44 begins at about roll forming stand No. 18 and is completed at roll forming stand No. 27.

As can also be seen in FIG. 1, the decking unit 34 has at least one longitudinal stiffening rib 46 formed in the central crest 48 of the central flute 38 at the first roll forming stand No. 1. The decking unit 34 also includes stiffening ribs 50, one each formed in the webs 52. Formation of the first rib 50 commences at roll forming stand No. 2, formation of a second stiffening rib in the adjacent web 52 commences at roll forming stand No. 7, and formation of a third stiffening rib 50 in the web 52 commences at roll forming stand No. 13. Another longitudinal stiffening rib 46 is started in the lateral crest 54 of the lateral flute 42 at roll forming stand No. 11. In roll forming stand No. 20, a plurality of transverse embossments 56 are formed in each of the valleys 58 of the lateral trough 40 and of the partial trough 44.

According to current roll forming practices, the longitudinal stiffening ribs 46 and 50 are formed by laterally drawing-in the sheet metal strip 32. Thus when designing sheet metal decking units, such as the unit 34, sheet metal girth must be allocated for the formation of the ribs 46, 50.

Figure 2:
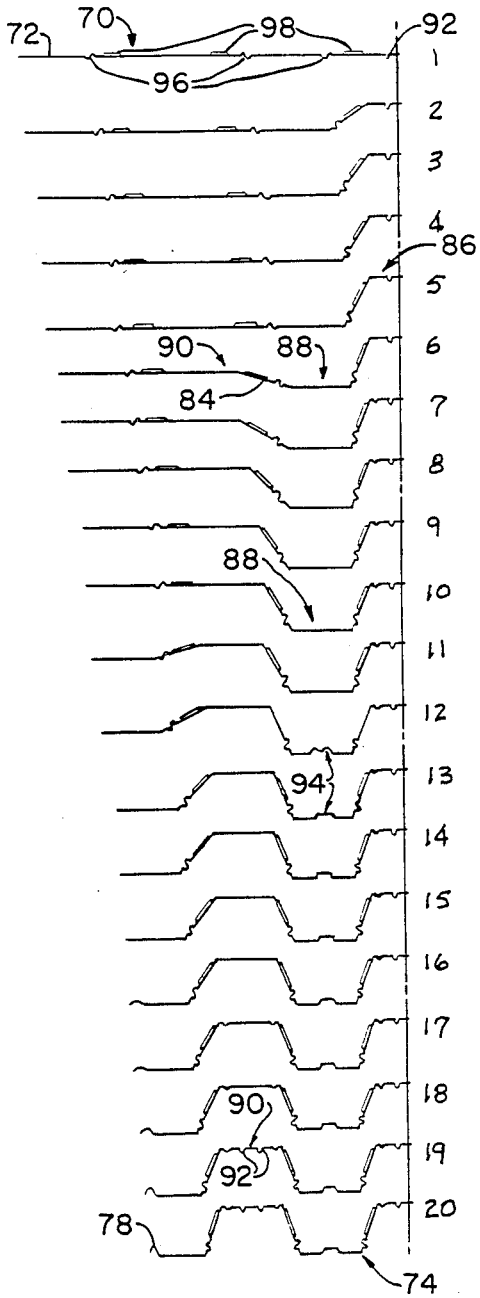
FIG. 2 is a flow diagram schematically illustrating roll forming of a profiled sheet metal decking unit according to the present invention.
Figure 3:
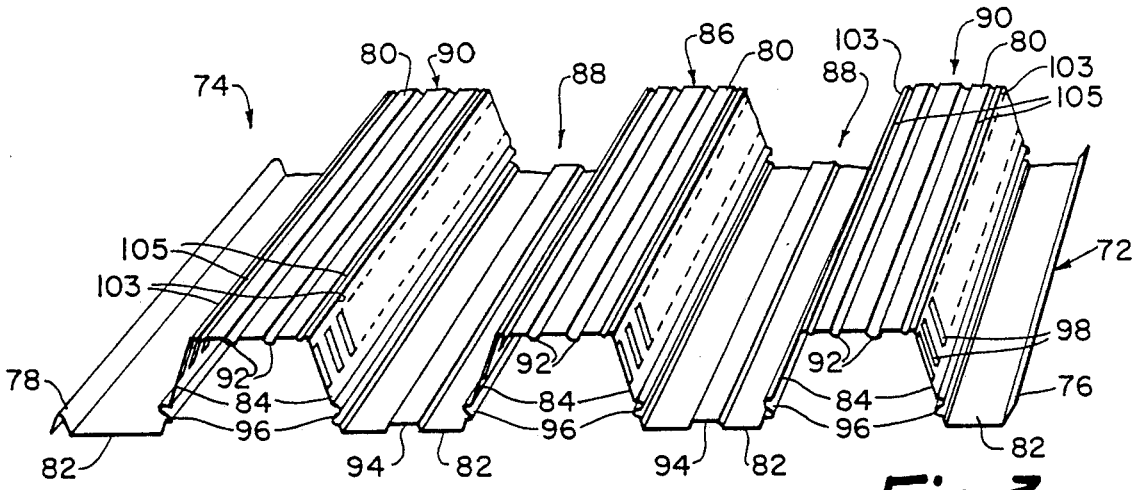
FIG. 3 is a fragmentary perspective view of an embodiment of the sheet metal decking unit of this invention.

Referring now to FIG. 2, there is shown a flow diagram 70 schematically illustrating the profiling of a sheet metal strip 72 to produce a decking unit 74 according to the present invention. The metal strip 72 may comprise steel, aluminum, zinc or other ductile metals or metal alloys. FIG. 2 illustrates only one-half of the decking unit 74 and it should be understood that the opposite half is essentially a mirror image of the half shown in FIG. 2. As illustrated in FIG. 3, the decking unit 74 has marginal connectors along the opposite longitudinal edges thereof which comprise, for example, a male lip 76 and a female lip 78 which are adapted to interconnect with a female lip 78 and a male lip 76 of adjacent decking units 74 to connect the units together. The decking unit 74 presents alternating crests 80 and valleys 82, and sloped webs 84 connecting adjacent ones of the crests 80 and the valleys 82. The decking unit 74 presents a central flute 86 consisting of a central crest 80 and the adjoining sloped webs 84; lateral troughs 88 each comprising one of the valleys 82 and the adjoining sloped webs 84; and lateral flutes 90 each comprising one of a lateral crest 80 and the adjoining sloped webs 84.

Figure 17:
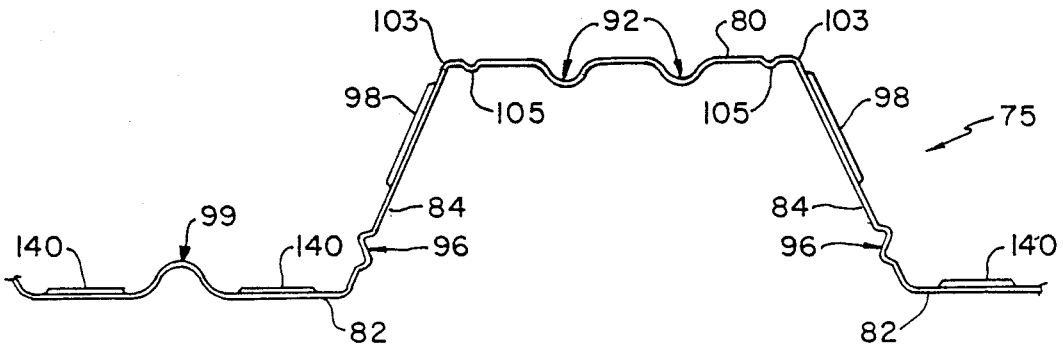
FIG. 17 is an enlarged view of a flute and the adjacent valleys of a further embodiment of a decking unit of this invention.

Each of the crest 80 is provided with at least one and preferably two longitudinally extending first stiffening ribs 92; the lateral valleys 82 each are provided with at least one longitudinally extending second stiffening rib 94; and each of the sloped webs 84 is provided with at least one longitudinal extending third stiffening rib 96. The ribs 92, 94 and 96 extend along substantially the entire length of the decking unit 74. In order to further enhance the composite co-action between the decking units 74 and an overlying layer of concrete, each of the sloped webs 84 is provided with a plurality of transversely extending embossments 98. In order to strengthen each juncture 103 between the sloped webs 84 and the crests 80 so as to better resist impact loads due to construction traffic, a longitundinal rib 105 is provided immediately adjacent to each juncture 103. The stiffening ribs 105 preferably are provided in the crests 80 as illustrated in FIGS. 3 and 17, but, alternatively, may be provided in the webs 84 immediately adjacent to each juncture 103.

Figure 4:
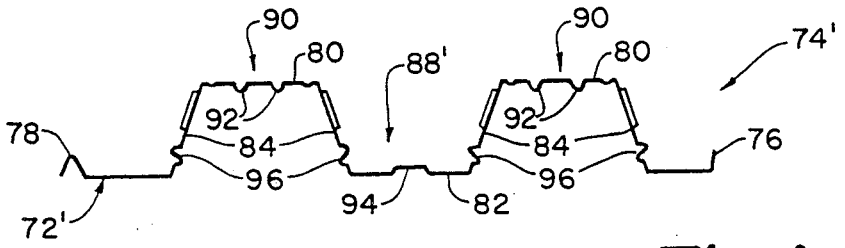
FIG. 4 is an end view of a further embodiment of the sheet metal decking unit of this invention.

FIG. 3 illustrates the decking unit 74 having three flutes 90, 86 and 90 and two troughs 88, 88. A commercial embodiment of the decking 74 would have coverage width of 36" (91.44 cm). FIG. 4 illustrates a narrower decking unit 74' having two flutes 90, 90 and one central trough 88'. A commercial embodiment of the decking unit 74' would have a coverage width of 24" (60.96 cm). The first, second and third longitudinal stiffener beads 92, 94 and 96 are formed in the sheet metal strips 72 (FIG. 3) and 72' (FIG. 4) in first, second and third regions corresponding, respectively, to the crests 80, the valleys 82 and the webs 84.

In one mode of practicing the present invention, the first roll forming stand receives the sheet metal strip 72 as a flat sheet and while the strip 72 passes therethrough, forms the embossments 98 and the third stiffening ribs 96 in the third longitudinal regions of the strip 72 which will correspond to the sloped webs 84. In addition, it is preferred that the first stiffening ribs 92 (only one visible in FIG. 2) be provided in a central region of the strip 72 which will correspond to the central crest 80 (FIG. 3).

Figure 5:
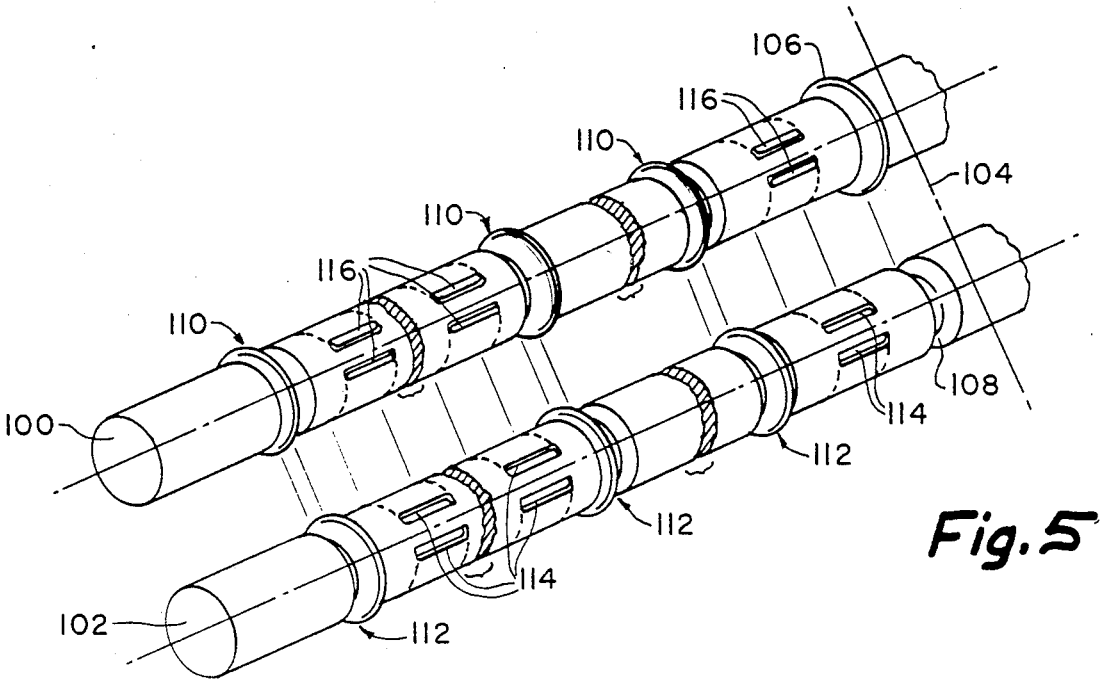
FIG. 5 is fragmentary isometric view of forming rolls used in a first roll forming stand according to this invention.

As shown in FIG. 5, the roll forming stand No. 1 utilizes upper and lower rolls 100, 102, of which only one-half are illustrated. The rolls 100 and 102 are symmetrical about the vertical axis 104. The rolls 100, 102 are provided with a cooperating rib 106 and groove 108 for forming the first stiffening rib 92; with a plurality of cooperating rib and groove formation 110, 112 for forming the third stiffening ribs 96; and with circumferentially spaced projections 114 on the lower roll 102 and with cooperating circumferentially spaced recesses 116 on the upper roll 100 for forming the embossments 98.

Figure 6:
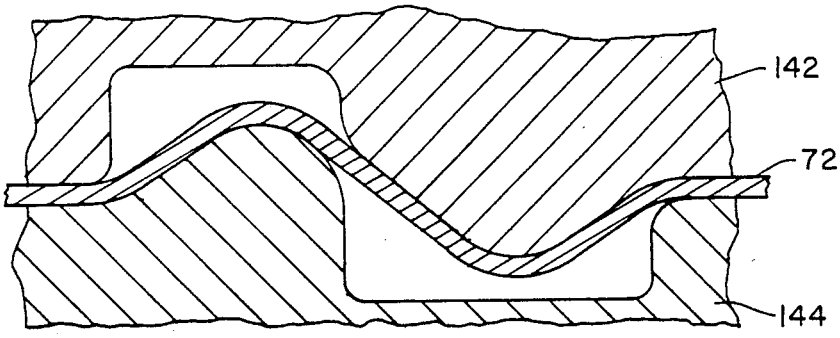
FIGS. 6 and 7 are fragmentary cross-sectional views, taken transversely through forming rolls, illustrating the two-step stretch-in of a stiffening rib.
Figure 7:
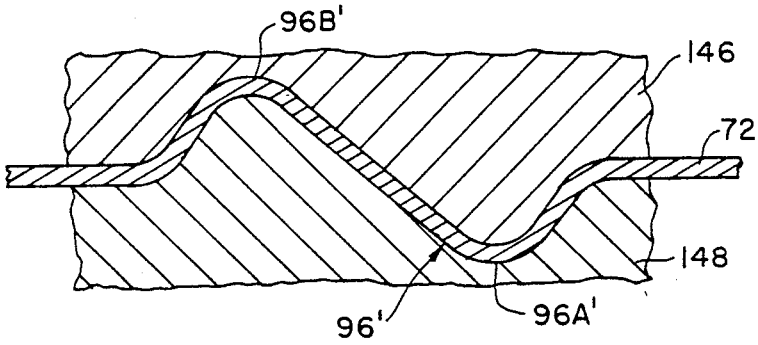

In another mode of practicing the present invention, a third stiffening ribs 96' could be formed by passing the sheet metal strip 72 through two consecutive roll forming stands as shown in FIGS. 6 and 7. FIG. 6 illustrates fragments of upper and lower rolls 142, 144 which introduce a relatively shallow S-bend into the sheet metal strip 72, such S-bend being wider and shallower than the completed S-bend in forming the stiffening rib 96' of FIG. 7. Thus the material is stretched over a wider area, providing adequate girth for the completed S-Bend of the stiffening rib 96' at a lesser percentage of stretch. FIG. 7 illustrates fragments of upper and lower rolls 146, 148 which form the rib 96' with the rib-like projections 96A', 96B'. The two-step formation of the rib 96' as illustrated in FIGS. 6 and 7 is preferred when the sheet metal strips 72 of less ductile metals are used.

Figure 8A:
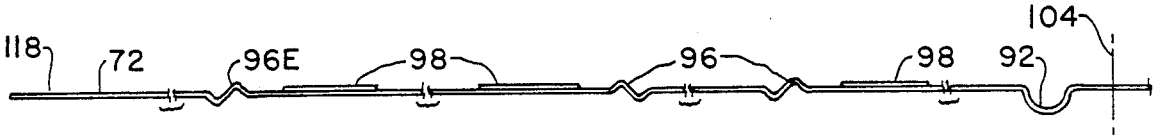
FIGS. 8A and 8B are end views of the left-hand side and the right-hand side, respectfully of the sheet metal strip as it emerges from rolls of FIG. 5.
Figure 8B:
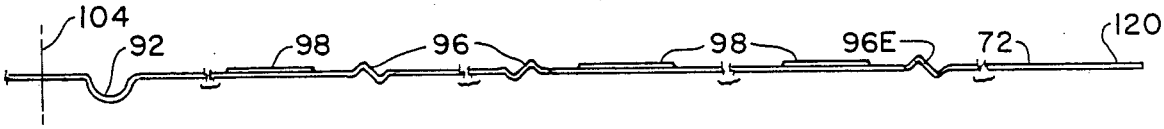

With references to FIGS. 8A and 8B, it should be noted that the outermost third stiffening ribs 96E adjacent to the opposite ends 118, 120 of the sheet metal strip 72 serve to restrain the portion of the sheet metal 72 therebetween against being laterally drawn-in toward the centerline 104. The stiffening ribs 96E are considered to be formed by drawing-in portions of the sheet metal strip 72. While in actual practice some stretching does occur in the formation of the stiffening ribs 96E, only the first stiffening ribs 92 and the four intermediate third stiffening ribs 96 are considered to be formed by stretching segments of the sheet metal strip 72 and as a result each have a substantially uniform rib thickness that is less than the uniform thickness of the sheet metal strip 72.

Figure 9:
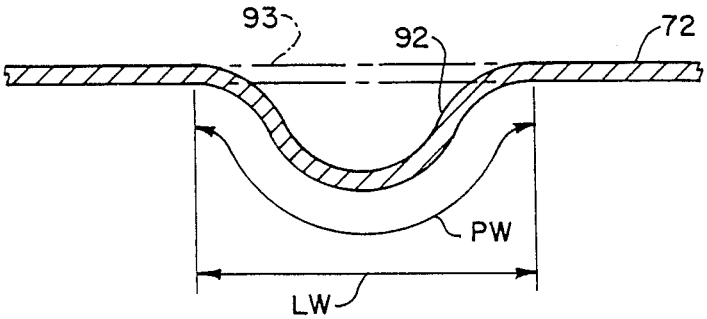
FIGS. 9 to 14 are fragmentary, transverse cross-sectional views of stiffening ribs.

As can be seen, for example, in FIG. 9, the first stiffening rib 92 is formed from a segment illustrated by the dash-dot line 93 of the sheet metal strip 72. The segment 93 has linear width LW. When formed, the first stiffening rib 92 has a profile width PW (as measured along the centerline of the rib 92) which is greater than the linear width LW of the segment 93.

Figure 10:
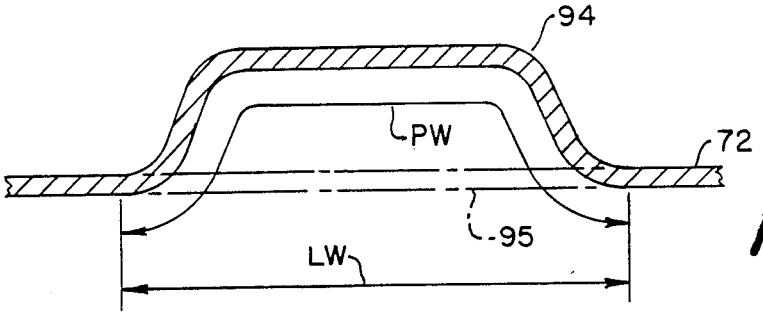

Likewise, as shown in FIG. 10, for example, the second stiffening rib 94 is stretched-in from a segment illustrated by the dash-dot line 95 of the sheet metal strip 72. The segment 95 has a linear width LW. When formed, the stiffening rib 94 has a trapazoidal configuation and a profile width PW (as measured along the centerline of the rib 94) which is greater than the linear width LW of the segment 95.

Figure 11:
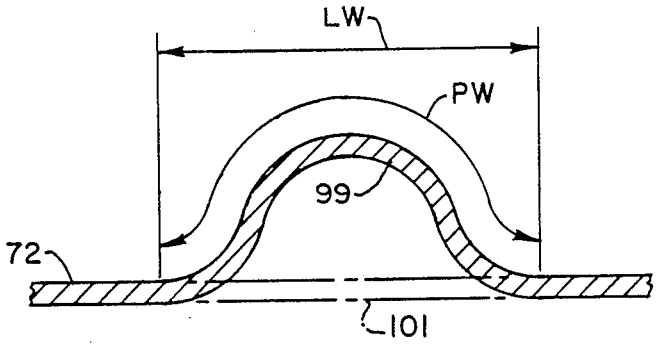

As an alternative, a second stiffening rib 99 (FIG. 11) may be provided, having an arcuate configuation similar to that of the first stiffening rib 92 (FIG. 9). The stiffening rib 99 is stretched-in from a segment illustrated by the dash-dot line 101 of the sheet metal strip 72. The segment 101 has a linear width LW. When formed, the stiffening rib 99 has profile width PW (as measured along the centerline of the rib 99) which is greater than the linear width LW of the segment 101.

Figure 12:
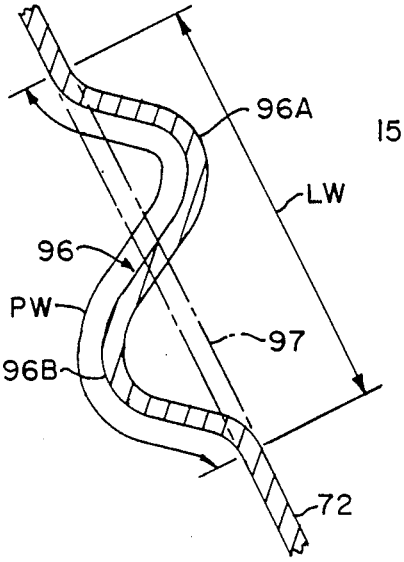
Figure 13:
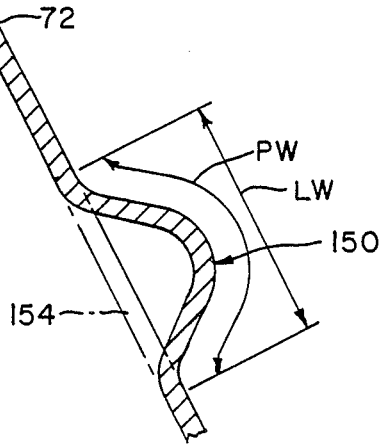
Figure 14:
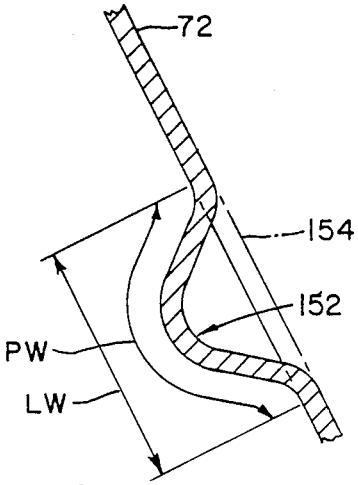

Likewise, as shown in FIG. 12, for example, the third stiffening rib 96 is formed from a segment illustrated by the dash-dot line 97 of the strip 72—the segment 97 having a linear width LW. When formed the third stiffening rib 96 has a profile width PW which is greater than the linear width LW of the segment 97. Alternatively, the third stiffening rib may take the form of an outwardly projecting rib 150 (FIG. 13) or an inwardly projecting rib 152 (FIG. 14) each of which is formed by stretching a segment illustrated by the dash-dot line 154 of the strip 72. When formed, the ribs 150, 152 each have a profile width PW which is greater than the linear width LW of the segment 154.

It will be appreciated that the savings in the overall sheet metal girth corresponds to the sum of the differences between the profile widths PW and the linear widths LW of the stiffener ribs used in the building unit.

As can best be seen in FIG. 12, the third stiffening rib 96 has an S-shaped configuration including rib-like projections 96A, 96B projecting from opposite sides of the sloped web 84. The rib-like projection 96A projects away from the flute 86, 90 and thus positioned serves as a nesting bead on which the next higher decking unit will rest. The stacked decking units are precluded from jamming together. Thus the decking units are fully nestable in jam-free relation for packaging, storage and shipment.

Reverting to FIG. 2, as the sheet metal strip 72 passes through roll forming stand Nos. 2 through 5, the central flute 86 is formed. Thereafter, formation of the lateral trough 88 commences at roll forming stand No. 6 and is essentially complete at after roll forming stand No. 10. Formation of the lateral flutes 90 commences at roll forming stand No. 11 and is completed at about roll forming stand No. 19.

Figure 15:
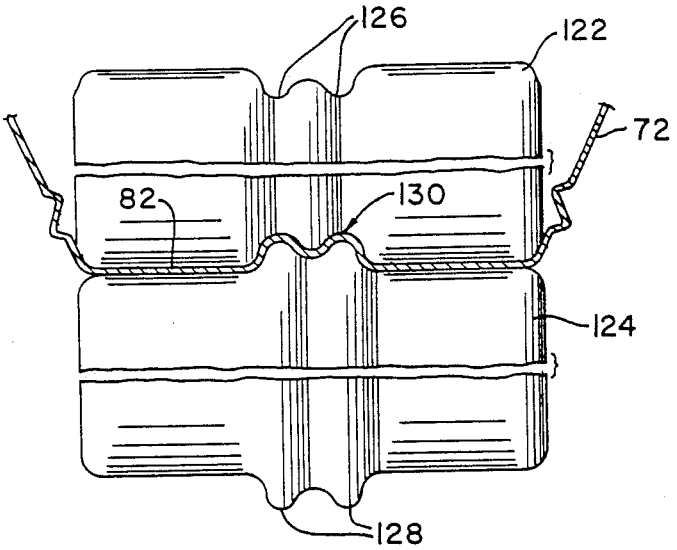
FIGS. 15 and 16 are cross-sectional views, taken transversely through a valley, illustrating the two-step stretch-in of a valley stiffening rib.
Figure 16:
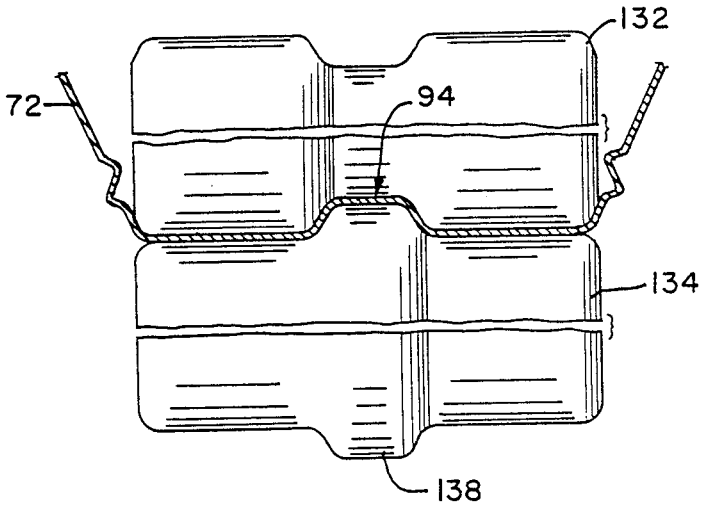

It will be observed that a longitudinal second stiffening rib 94 is formed in the valley at roll forming stand Nos. 12 and 13. The two-step formation of the second stiffening rib 94 is best illustrated in FIGS. 15 and 16. In FIG. 15 there is illustrated upper and lower rolls 122, 124, respectively. The upper roll 122 presents a pair of circumferential grooves 126 which cooperate with a pair of circumferential ribs 128 to provide initial stretching of the segment 95 (FIG. 10) of the valley 82 to produce the sinuous profile 130. The sheet 72 continues to roll forming stand No. 13 where, as shown in FIG. 16, there is presented upper and lower forming rolls 132, 134, respectively. The upper roll 132 presents a circumferential depression 136 which cooperates with the circumferential rib 138 to produce the final stretch-in of the second stiffening rib 94.

Reverting to FIG. 2, it will be observed that additional longitudinal first stiffening ribs 92 are stretched-in in the crests of the lateral flutes 90 at roll forming stand No. 19, in the manner hereinbefore described.

FIG. 17 illustrates a further embodiment of the present decking unit and is designated generally by the numeral 75. The decking unit 75 incorporates the second stiffening ribs 99 of FIG. 11, in those valleys 82 disposed between adjacent ones of the crests 80. Plural embossments 140 may be and preferably are formed in all of valleys 82. In those valleys 82 containing a stiffening rib 99, the embossments 140 are provided on each side of the rib 99. The embossments 140 extend transversely of the valleys 82 and serve as concrete keying elements that cooperate with the embossments 98 in the webs 84 to resist sliding and separation of the decking unit 75 from an overlying layer of hardened concrete (not shown) when the decking unit/concrete combination is subjected to shear forces.

Figure 18:
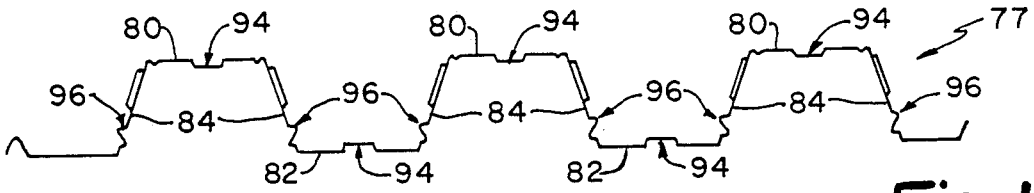
FIG. 18 is an end view of a further embodiment of the present sheet metal decking unit.

FIG. 18 illustrates a still further embodiment of the present decking unit and is designated generally by the numeral 77. In the decking unit 77, the crests 80 and those valleys 82 disposed between adjacent ones of the crests 80, each incorporate at least one of the stiffening ribs 94 whereas the sloped webs 84 incorporate the stiffening ribs 96.

The present invention is also applicable to other building units, such as, cellular floor deck, roof deck and the liners and facing sheets of wall structures.

Figure 19:
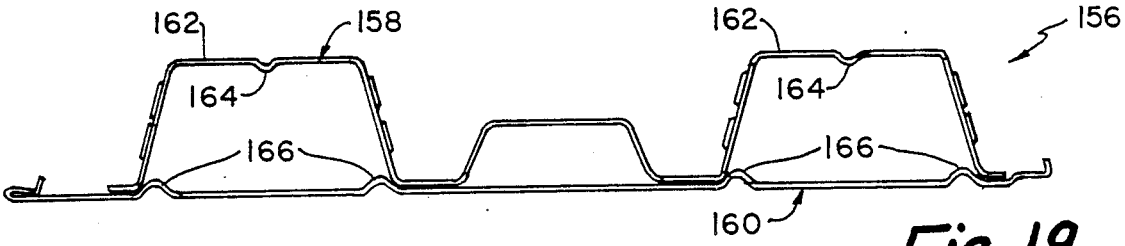
FIG. 19 is an end view of a cellular floor deck unit.

FIG. 19 illustrates a cellular decking unit 156 formed from a corrugated upper metal sheet 158 and an essentially flat lower sheet 160. The upper metal sheet 158 presents flat regions or crests 162 each provided with a stretched-in stiffening rib 164. The lower metal sheet 160 is provided with stretched-in stiffening ribs 166 which serve not only to strengthen and stiffen the wide flat expanse of the lower sheet 160 but also to position the upper sheet 158 with respect to the lower sheet during welding of the two sheets 158, 160.

Figure 20:
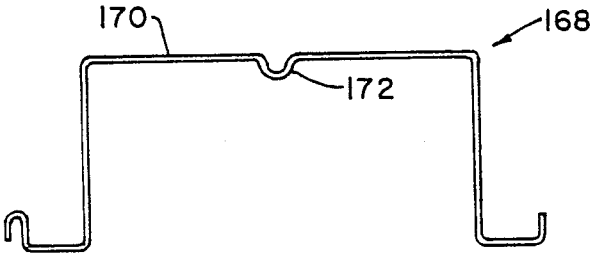
FIG. 20 is an end view of a hat-shaped roof deck unit.

FIG. 20 illustrates a hat-shaped roof deck 168 presenting a flat region or crest 170 provided with a stretched-in stiffening rib 172.

Figure 21:
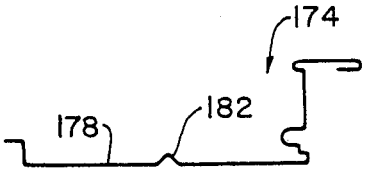
FIGS. 21 to 29 end views of typical profiled sheets used in sandwich constructions, such as, walls or roofs.
Figure 22:
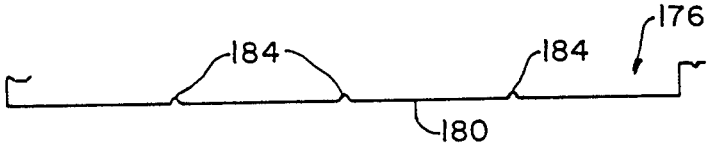

FIGS. 21 and 22 illustrate profiled sheets 174, 176 presenting flat regions or central webs 178, 180. The central web 178 of the liner 174 is provided with a single stretched-in stiffening rib 182. The wide central web 180 of the sheet 176 is provided with three substantially uniformed spaced, stretched-in stiffening ribs 184.

Figure 23:
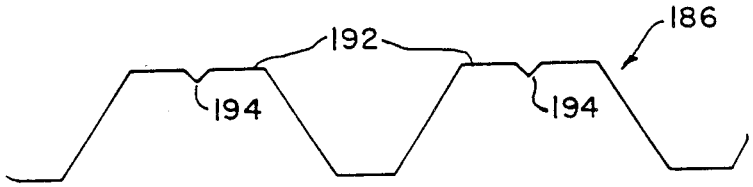
Figure 24:
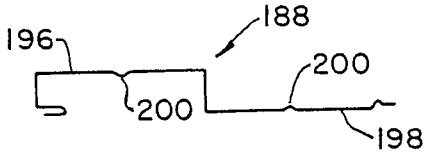
Figure 25:
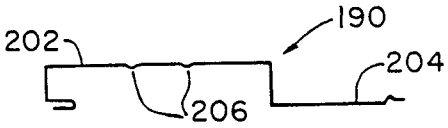
Figure 26:
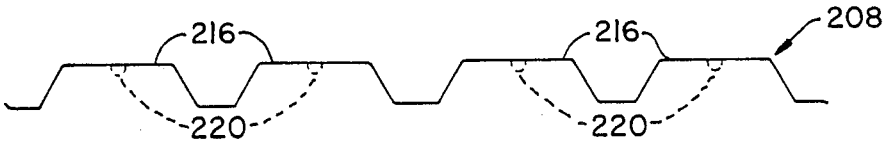
Figure 27:
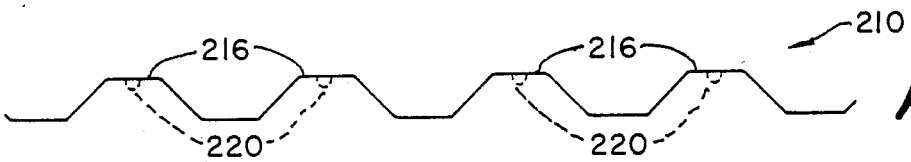
Figure 28:
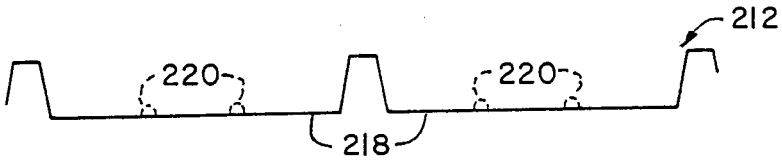
Figure 29:
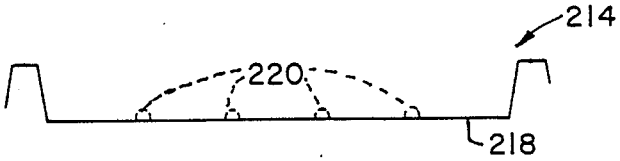

FIGS. 23, 24 and 25 illustrate profiled sheets 186, 188 and 190 used in single sheath structures or in double-sheath wall structures.

The profiled sheet 186 (FIG. 23) is corrugated and presents flat regions or crests 192 each provided with a stretch-in stiffening rib 194.

The profiled sheet 188 (FIG. 24) presents an outboard flat region or crest 196 and an inboard flat region or valley 198. The crest 196 and valley 198 are of substantially the same width and thus each is provided with a single stretched-in stiffening rib 200.

The profiled sheet 190 (FIG. 25) presents an outboard flat region or crest 202 and an inboard flat region or valley 204. Since the crest 202 is twice as wide as the valley 204, the crest 202 is provided with two spaced-apart stretched-in stiffening rib 206. The valley 204 is narrow enough that no stiffening rib is required.

FIGS. 26 to 29 illustrate profiled sheets 208, 210, 212 and 214 used in single sheath structures or in double sheath wall structures.

The profiled sheets 208 and 210 (FIGS. 26, 27) present plural flat regions or crests 216. The profiled sheets 212 and 214 (FIGS. 28, 29) have relatively wide flat regions or valleys 218. In accordance with the present invention, the crests 216 and valleys 218 can be provided with one or more stretched-in stiffening ribs represented by the dotted half-circles numbered 220 without having to increase the width of the sheet metal strip from which the profiled sheets 208 to 214 are formed.

It is to be understood that all of the stiffening ribs 164, 166, 172, 182, 184, 194, 200, 206 and 220 of FIGS. 19 to 29 extend longitudinally and substantially the entire length of the associated building unit.

The present invention also provides improvements in a method of making building units described herein; and building units, not specifically illustrated herein but intended to be encompassed by the claims, that incorporate not only the combinations illustrated but also other combinations of the stiffening ribs described herein in the longitudinal flat regions of the building units.

The method of the present invention also applies to building units incorporating stiffening ribs of any configuration which have been formed not by being drawn-in as in current roll forming practices, but, instead, by being stretched-in as disclosed in this specification.

The present invention provides improvements in the method of profiling a sheet metal strip that has a substantially uniform thickness and that is provided in a preselected width. The method provides a cold formed building unit such as a floor, roof or wall element illustrated in FIGS. 3, 4 and 17 to 29. The building unit is of the type having at least one longitudinal flat region that is subject to buckling on application of compressive forces. The improvement, according to the present invention, comprises forming at least one longitudinal stiffening rib in the flat region by stretching a segment of the flat region. The stiffening rib may be formed prior to profiling the sheet metal strips. Alternatively, the stiffening rib may be formed during profiling of the sheet metal strip.

In accordance with an alternative embodiment of the present method (a) at least one longitudinal stiffening rib (such as the rib 92) is formed in each of first regions (such as the crests 80) of the sheet metal strip 72 by stretching segments of the first regions; and (b) at least one longitudinal stiffening rib (such as the rib 94 or 99)

is formed in each of second regions (such as the valleys 82) of the sheet metal strip 72 by stretching segments of the second regions. Further in accordance with the present method (c) at least one longitudinal rib (such as the rib 96 or 150 or 152) is formed in each of third regions (such as the webs 84) of the strip 72 by stretching segments of the third regions.

In accordance with a further alternative embodiment of the present method and with reference to FIG. 2, (a) at least one longitudinal stiffening rib (such as the rib 92) is formed in a central one of first regions (such as the crests 80) of the sheet metal strip 72 by stretching a segment of the first region—the sheet metal strip 72 being restrained against being drawn-in laterally; (b) a central flute 86 comprising a central crest 80 and adjoining sloped webs 84 is formed by allowing the sheet metal strip 72 to be drawn-in freely and laterally; (c) troughs 88, one on each side of said central flute 86 are formed by allowing the sheet metal strip 72 to be drawn-in freely and laterally, the troughs 88 comprising second regions (such as the valleys 82) of the strip 72 and adjoining sloped webs 84; (d) at least one longitundinal stiffening rib (such as the rib 94 or 99) is formed in the second regions by stretching segments of the second regions—the sheet metal strip 72 being restrained against being drawn-in laterally; (e) lateral flutes 90, one adjacent to each of the lateral troughs 88 are formed by allowing the sheet metal strip 72 to drawn-in freely and laterally, the lateral flutes 90 comprising first regions (such as lateral crests 80) and adjoining sloped webs 84; (f) at least one longitudinal stiffening rib (such as the rib 92) is formed in the first regions of the lateral flutes 90 by stretching segments of the first regions—the sheet metal strip 72 being restrained against being drawn-in laterally; the stiffening ribs each having a profile width PW that is greater than the linear width LW of the segments from which each was stretched-in and having a substantially uniform rib thickness which is less than the uniform thickness of the sheet metal strip 72.

Further in accordance with this embodiment, (g) at least one longitundinal stiffening rib (such as the rib 96 or 150 or 152) is formed in each of third regions by stretching segments of the third regions—the sheet metal strip 72 being restrained against being drawn-in laterally, each of the third stiffening ribs having a profile width PW that is greater than the linear width LW of the segments from which each was stretched-in and having a substantially uniform rib thickness that is less than the uniform thickness of the sheet metal strip 72.

Figure 30:
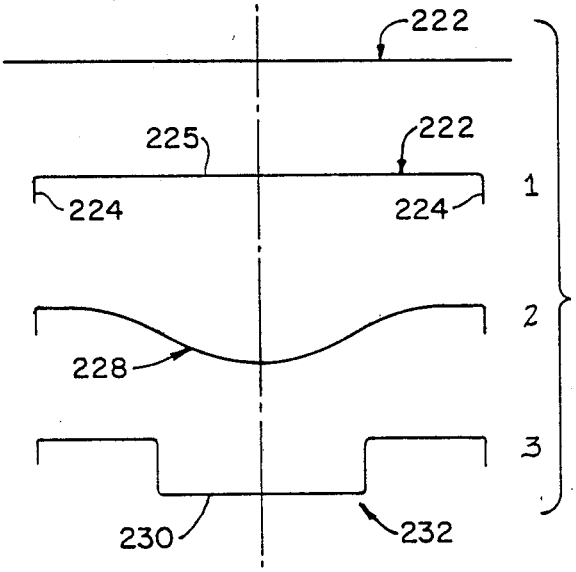
FIG. 30 is a flow diagram schematically illustrating roll forming of a structural element according to the present invention.
Figure 31:
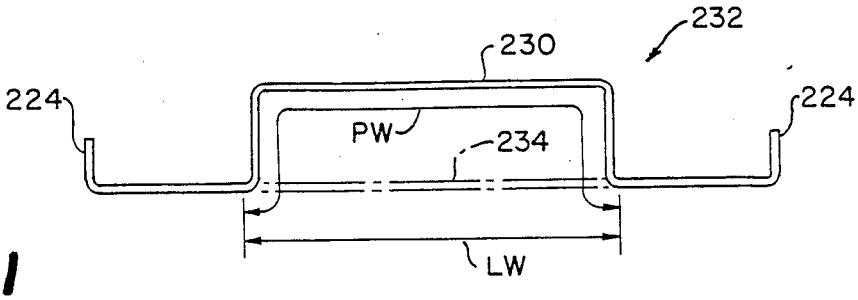
FIG. 31 is an end view of the structural element formed in FIG. 30.

As schematically illustrated in the flow diagram of FIG. 30, the principles of the present invention may also be employed to profile a sheet metal strip 222 to form a structural element, such as, as hat-shaped subgirt 232 (FIGS. 30, 31). The sheet metal strip 222 is passed through three successive roll forming stands. In stand No. 1, the opposite outer edges of the sheet metal strip 222 are turned down to form edge flanges 224 that in restraining the sheet metal strip 222 from being drawn-in laterally. The sheet metal strip 222 now presents a longitudinally extending flat region 225 that must be stiffened and stregthened. In accordance with the present invention, the strip 222 is passed through stand Nos. 2 and 3 during which the flat region 225 is stretched in stand No. 2 to provide a stretched portion 228 of adequate girth to form in stand No. 3 a completed U-shaped stiffening rib 230. Exiting from stand No. 3 is a completed structural element 232.

As best seen in FIG. 31, the U-shaped stiffening rib 232 is stretched from a segment illustrated by the dash-dot line 234 of the sheet metal strip 222. The stretched-in U-shaped stiffening rib 230 has a profile width PW that is greater than the linear width LW of the segment 234. Since the segment 234 was stretched to form the U-shaped stiffening rib 230, the U-shaped stiffening rib 230 has a substantially uniform rib thickness that is less than the uniform sheet thickness of the sheet metal strip 22.

As a result of the present method, a significant savings in sheet metal usage is achieved. For example, the decking unit 74 illustrated in FIG. 3, if made according to current roll forming practices wherein the ribs 92, 94 and 96 are drawn-in, would require a sheet metal girth of 51.96 inches (131.98 cm). The same decking unit 74 (FIG. 3) fabricated in accordance with the principles of the present invention and assuming the stiffening ribs 96E (FIGS. 8A and 8B) are formed by being drawn-in, would have a sheet metal girth of 49.57 inches (125.91 cm).

Thus, the forming of the first, second and third stiffening ribs 92, 94 and 96, using the principals of the present invention, result in a sheet metal girth savings of 2.39 inches (6.07 cm), when compared to that sheet metal girth required by current roll forming practices. This represents a sheet metal savings of 4.6%, with essentially no sacrifice in the strength and stiffness of the resulting building unit.

Further, as a result of this invention, the number of roll stands of a roll forming machine required to produce a building unit or structural element, can be significantly reduced. A comparison of FIGS. 1 and 2 will show that a profile made in accordance with the principles of this invention requires only twenty consecutive, individual operations whereas the same profile when made in accordance with present and past roll forming practices requires twenty-seven consecutive individual operations. Each of the individual operations represents a roll stand of a roll standing machine.

We claim:

1. In a profiled building unit formed from sheet metal having a substantially uniform sheet thickness and presenting alternating crests and valleys, and sloped webs connecting adjacent ones of said crests and said valleys, the improvement comprising:

first and second stiffening ribs formed, respectively, in said crests and said valleys, said stiffening ribs extending longitudinally along substantially the entire length of said building unit and each having a substantially uniform rib thickness that is less than said uniform sheet thickness of said metal sheet.

2. The building unit as defined in claim 1 including third stiffening ribs formed in said webs, extending longitudinally along substantially the entire length of said building unit and each having a substantially uniform rib thickness that is less than said uniform sheet thickness of said metal sheet.

3. The building unit as defined in claim 1 wherein only those of said valleys disposed between adjacent ones of said crests each include at least one of said second stiffening ribs.

4. The building unit as defined in claim 1 or 2 wherein the firth of said sheet metal is less than that required to produce a decking unit identical in profile to said building unit but with stiffening ribs having a rib thickness substantially equal to said uniform thickness of said sheet metal.

5. The building unit as defined in claim 1 or 2 wherein said stiffening ribs are stretched-in.

6. The building unit as defined in claim 1 or 2 wherein each of said stiffening ribs has a profile width that is greater than the linear width of the segment of said sheet metal from which each was stretched-in.

* * * * *